US007363712B1

(12) United States Patent
Huang et al.

(10) Patent No.: US 7,363,712 B1
(45) Date of Patent: Apr. 29, 2008

(54) CUTTING TOOL HAVING DETACHABLE GRIPS

(75) Inventors: Chien-Che Huang, Changhua County (TW); Ming-Chyuan Ho, Yunlin County (TW)

(73) Assignee: Tai-Wei Scissors Co., Ltd., Changhua County (TW)

( * ) Notice: Subject to any disclaimer, the term of this patent is extended or adjusted under 35 U.S.C. 154(b) by 86 days.

(21) Appl. No.: 11/375,447

(22) Filed: Mar. 14, 2006

(51) Int. Cl.
*B26B 13/00* (2006.01)
*B25G 3/02* (2006.01)

(52) U.S. Cl. ..... 30/260; 30/341; 30/244; 30/254

(58) Field of Classification Search ..... 30/260, 30/329–331, 151–162, 338, 312, 131–135, 30/341, 146, 194, 231–232, 236; 15/145, 15/422; 81/421–424, 177.7
See application file for complete search history.

(56) References Cited

U.S. PATENT DOCUMENTS 1,861,363 A * 5/1932 Scheuner ..... 403/289
2,439,071 A * 4/1948 Basham ..... 279/77
2,695,450 A * 11/1954 Platts ..... 30/342
4,495,696 A * 1/1985 Fethke et al. ..... 30/138
5,404,616 A * 4/1995 Carmien ..... 16/422
5,430,941 A * 7/1995 Lin ..... 30/260
6,273,882 B1 * 8/2001 Whittier et al. ..... 606/1
6,605,077 B2 * 8/2003 Whittier et al. ..... 606/1
7,210,230 B2 * 5/2007 Wurzel ..... 30/260

* cited by examiner

*Primary Examiner*—Terrence R. Till
*Assistant Examiner*—Joseph DeFrank
(74) *Attorney, Agent, or Firm*—Alan Kamrath; Kamrath & Associates PA

(57) ABSTRACT

A cutting tool includes two metal handles each having a first end formed with a mounting portion and a second end formed with a blade portion, and two plastic grips each having an inside formed with a mounting hole mounted on the mounting portion of the respective metal handle. The mounting hole of each of the plastic grips has a first end formed with a first separation slot and a second end formed with a second separation slot. Thus, the plastic grips are detachable from the metal handles when the cutting tool is worn out, so that the plastic grips and the metal handles are separated from each other, thereby facilitating reuse of the plastic grips and the metal handles.

6 Claims, 6 Drawing Sheets

CUTTING TOOL HAVING DETACHABLE GRIPS

BACKGROUND OF THE INVENTION

1. Field of the Invention

The present invention relates to a cutting tool and, more particularly, to a cutting tool, such as a pair of scissors and the like.

2. Description of the Related Art

A conventional cutting tool, such as a pair of scissors and the like, comprises two metal handles pivotally connected with each other and each having a first end formed with a shank and a second end formed with a blade, and two plastic grips each fixed on the shank of a respective one of the metal handles. However, the plastic grips are fixed on the metal handles without detachment, so that the plastic grips cannot be separated from the metal handles when the cutting tool is worn out, thereby causing inconvenience in reuse of the plastic grips and the metal handles.

BRIEF SUMMARY OF THE INVENTION

In accordance with the present invention, there is provided a cutting tool, comprising two metal handles pivotally connected with each other and each having a first end formed with a mounting portion and a second end formed with a blade portion, and two plastic grips each mounted on a respective one of the metal handles and each having an inside formed with a mounting hole mounted on the mounting portion of the respective metal handle. The mounting hole of each of the plastic grips has a first end formed with a first separation slot and a second end formed with a second separation slot.

The primary objective of the present invention is to provide a cutting tool having detachable grips.

Another objective of the present invention is to provide a cutting tool, wherein the plastic grips are detachable from the metal handles when the cutting tool is worn out, so that the plastic grips and the metal handles are separated from each other, thereby facilitating reuse of the plastic grips and the metal handles.

A further objective of the present invention is to provide a cutting tool, wherein the user applies a bending force on the plastic grips relative to the metal handles to break the first separation slot and the second separation slot of each of the plastic grips, thereby separating the plastic grips from the metal handles.

A further objective of the present invention is to provide a cutting tool, wherein the bending force is applied on the first separation slot and the second separation slot of each of the plastic grips from the starting portion having the smallest thickness and weakest strength so that the first separation slot and the second separation slot of each of the plastic grips are broken easily and rapidly, thereby saving the manual work, and thereby facilitating the user separating the plastic grips from the metal handles.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
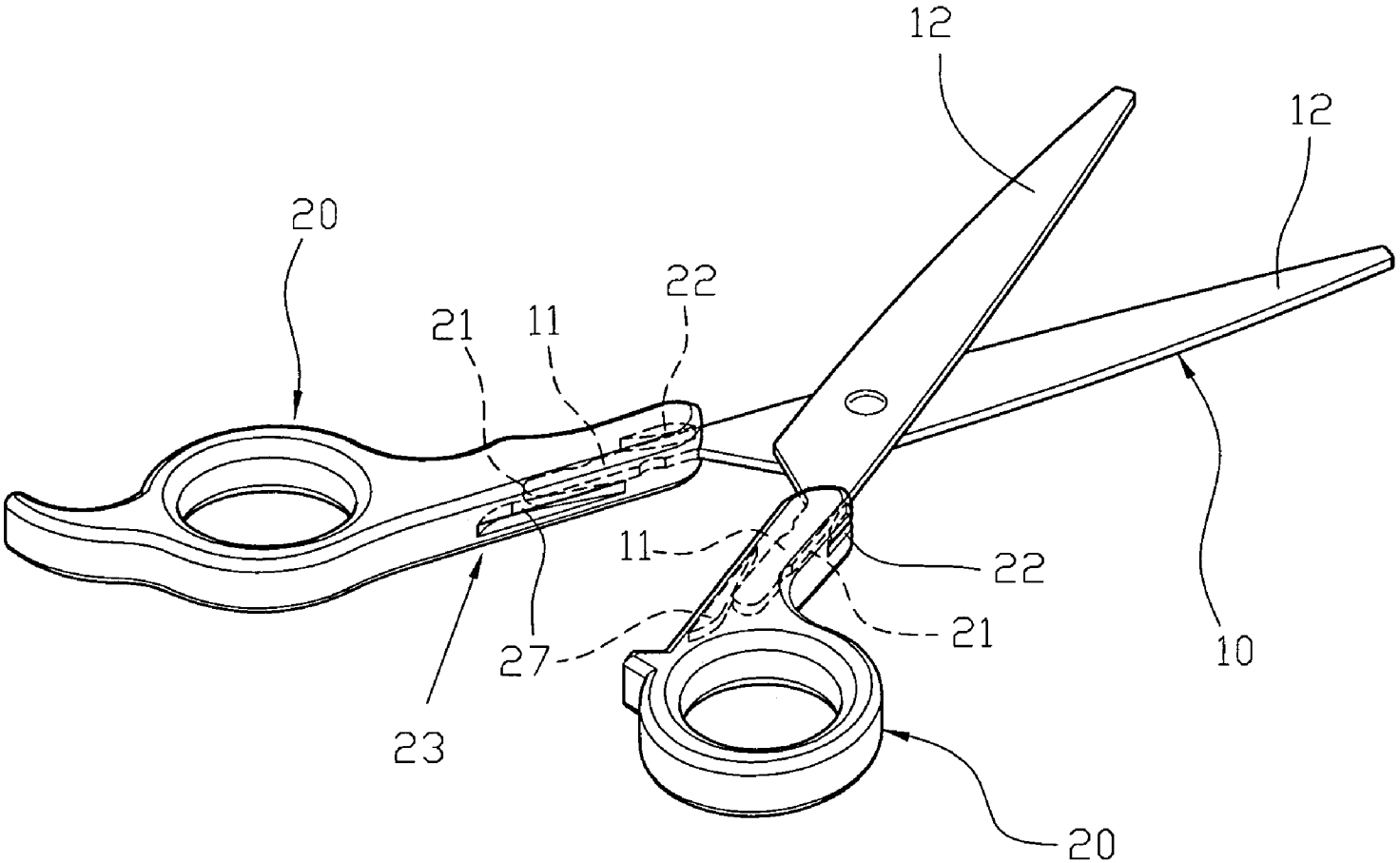
FIG. 1 is a perspective view of a cutting tool in accordance with the preferred embodiment of the present invention.
Figure 2:
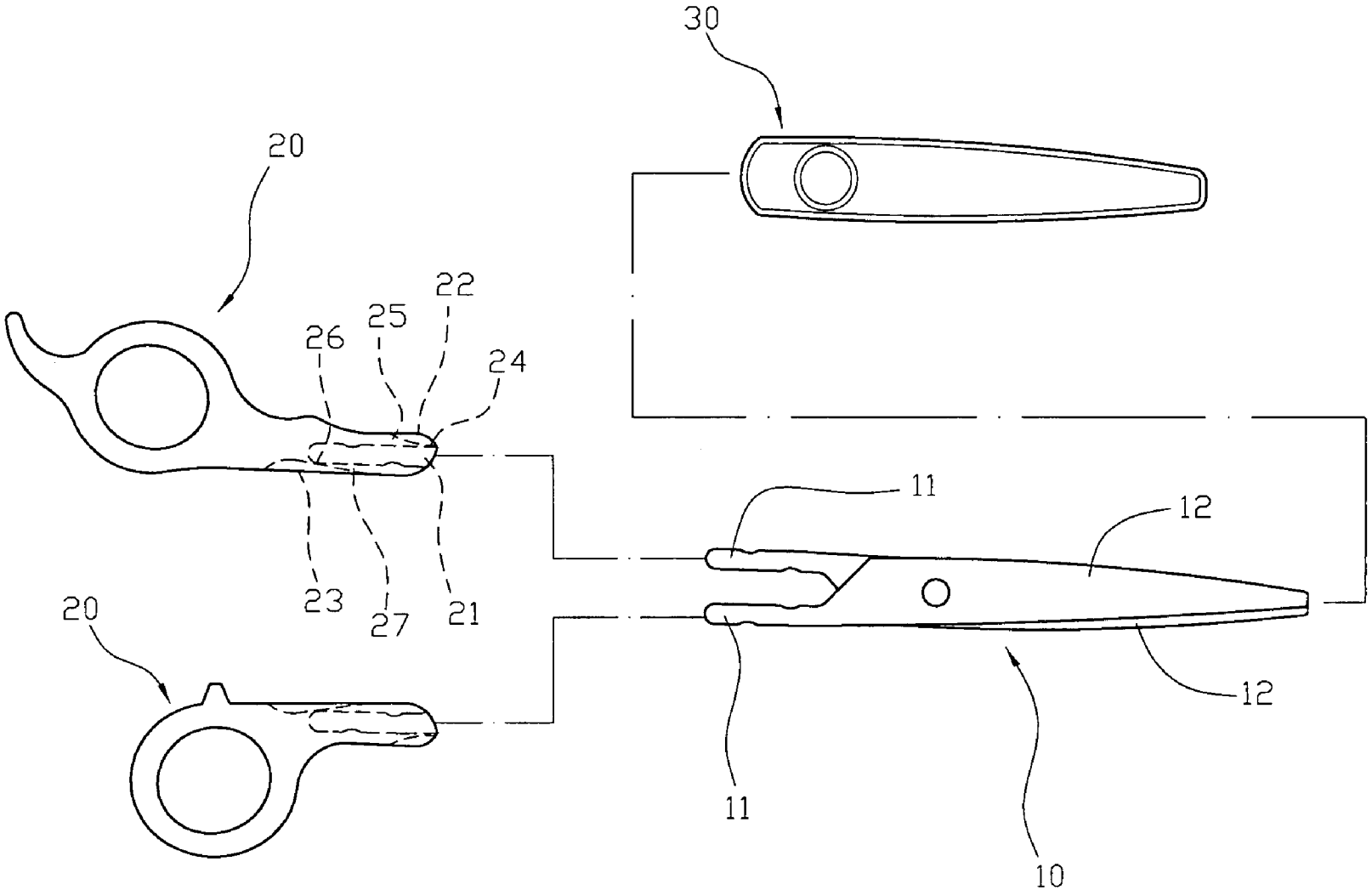
FIG. 2 is a plan exploded view of the cutting tool as shown in FIG. 1.
Figure 3:
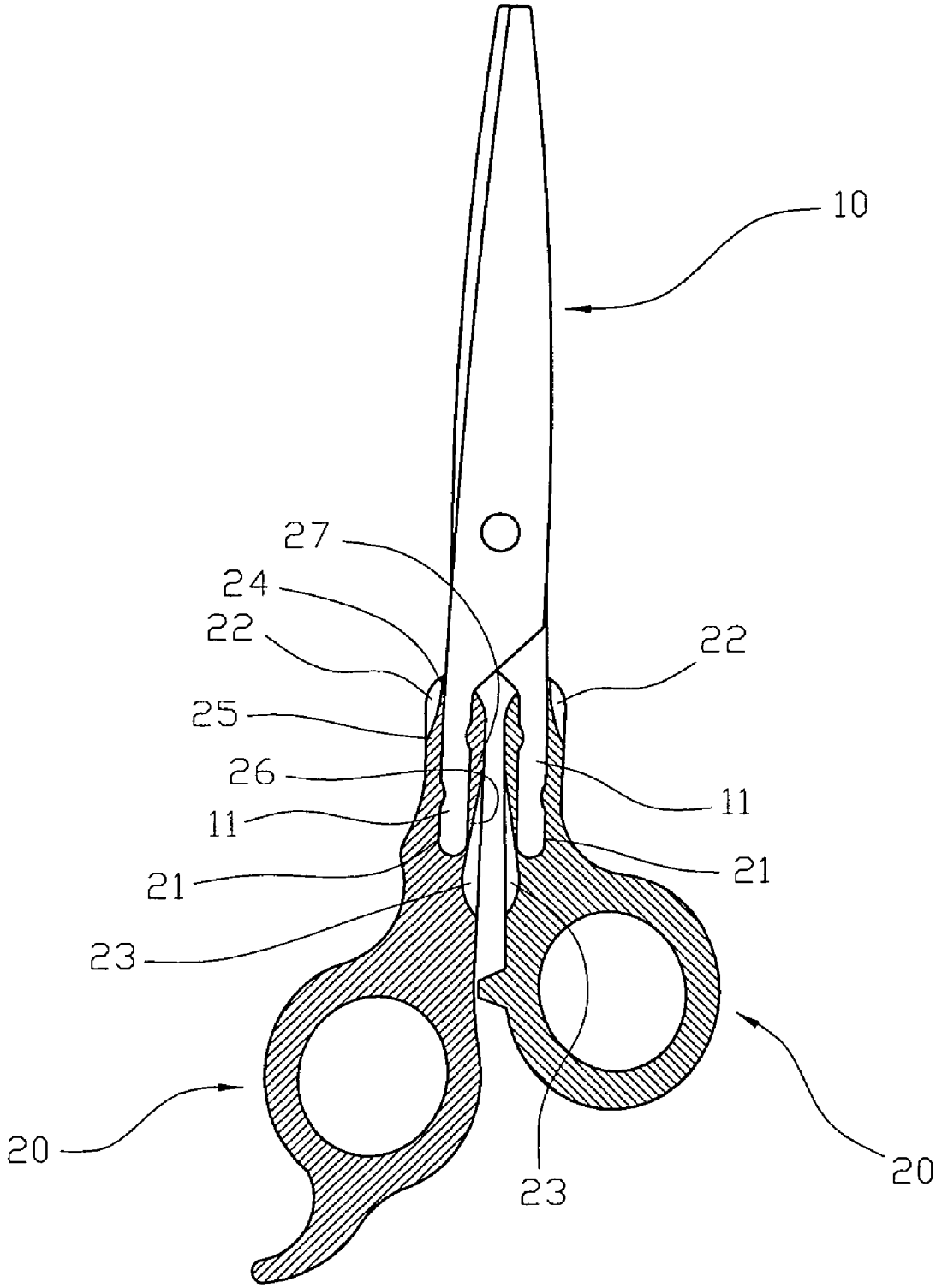
FIG. 3 is a plan cross-sectional view of the cutting tool as shown in FIG. 1.

Referring to the drawings and initially to FIGS. 1-3, a cutting tool in accordance with the preferred embodiment of the present invention comprises two metal handles 10 pivotally connected with each other and each having a first end formed with a mounting portion 11 and a second end formed with a blade portion 12, and two plastic grips 20 each mounted on a respective one of the metal handles 10 and each having an inside formed with a mounting hole 21 mounted on the mounting portion 11 of the respective metal handle 10.

The mounting hole 21 of each of the plastic grips 20 has a first end formed with a first separation slot 22 and a second end formed with a second separation slot 23. The first separation slot 22 and the second separation slot 23 are located at two opposite sides of the mounting hole 21 of each of the plastic grips 20. The first end of the mounting hole 21 of each of the plastic grips 20 has an open wall, and the second end of the mounting hole 21 of each of the plastic grips 20 has a closed wall.

The first separation slot 22 of each of the plastic grips 20 has an outer side having a starting portion 24 and an ending portion 25. The outer side of the first separation slot 22 of each of the plastic grips 20 has a thickness gradually increased from the starting portion 24 to the ending portion 25.

The second separation slot 23 of each of the plastic grips 20 has an outer side having a starting portion 26 and an ending portion 27. The outer side of the second separation slot 23 of each of the plastic grips 20 has a thickness gradually increased from the starting portion 26 to the ending portion 27.

Figure 4:
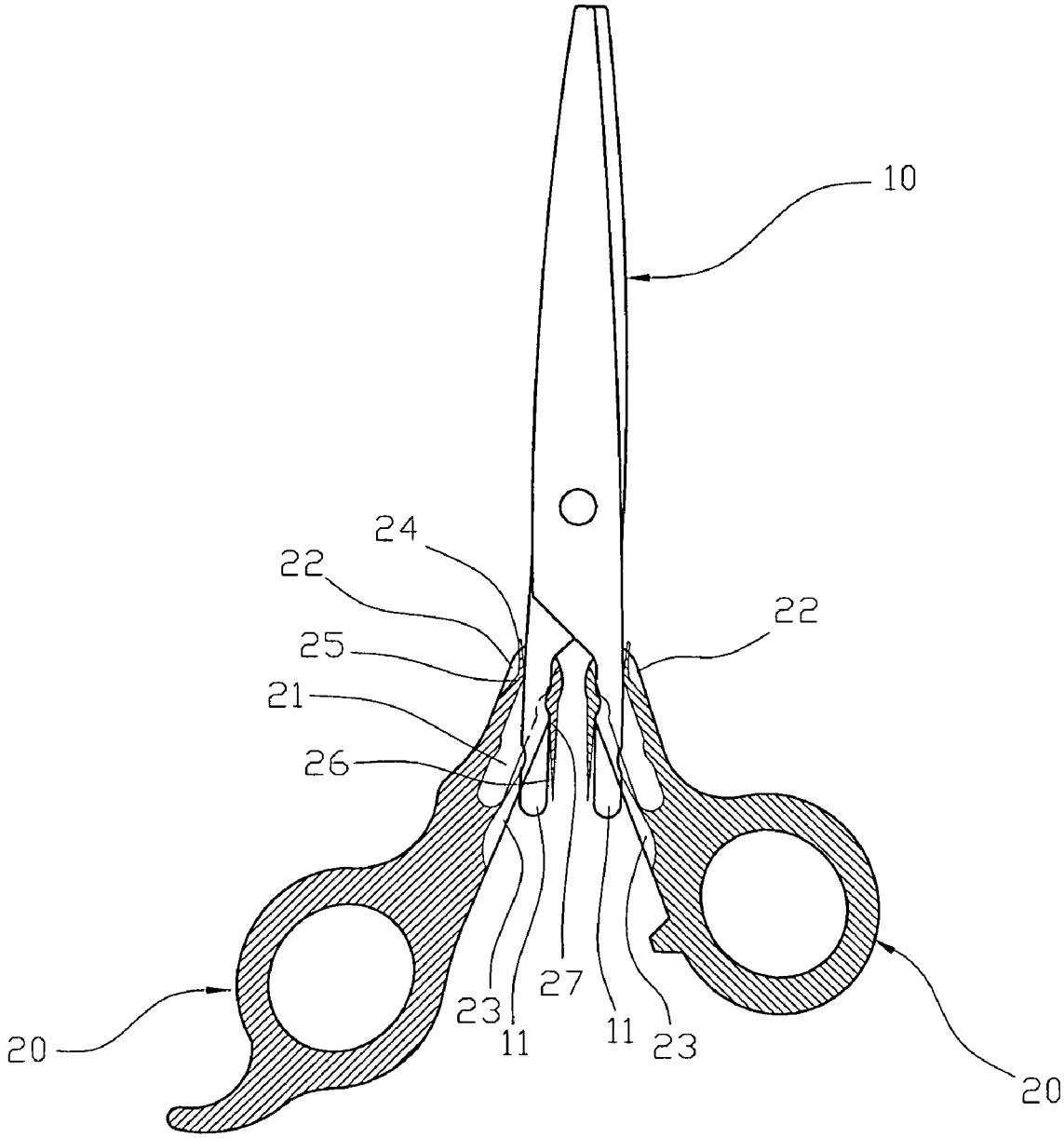
FIG. 4 is a schematic operational view of the cutting tool as shown in FIG. 3.

As shown in FIG. 4, when a user wishes to separate the plastic grips 20 from the metal handles 10, the user applies a bending force on the plastic grips 20 relative to the metal handles 10. In such a manner, the mounting portion 11 of each of the metal handles 10 has a front end pushed toward the first separation slot 22 of the respective plastic grip 20 by the bending force and a rear end pushed toward the second separation slot 23 of the respective plastic grip 20 by the bending force so as to bend the first separation slot 22 and the second separation slot 23 of each of the plastic grips 20, thereby separating the plastic grips 20 from the metal handles 10. At this time, the bending force is applied on the first separation slot 22 and the second separation slot 23 of each of the plastic grips 20 from the starting portion 24 and 26 having the smallest thickness and weakest strength so that the first separation slot 22 and the second separation slot 23 of each of the plastic grips 20 are bent easily and rapidly, thereby saving the manual work, and thereby facilitating the user separating the plastic grips 20 from the metal handles 10.

As shown in FIG. 2, the cutting tool further comprises a protective cover 30 mounted on the blade portions 12 of the metal handles 10 to protect the blade portions 12 of the metal handles 10. In addition, the protective cover 30 is mounted on the blade portions 12 of the metal handles 10 to hold the metal handles 10 so that the user's hand can hold the protective cover 30 to apply the bending force on the plastic grips 20 so as to bend the plastic grips 20 by the metal handles 10, thereby separating the plastic grips 20 from the metal handles 10.

Figure 5:
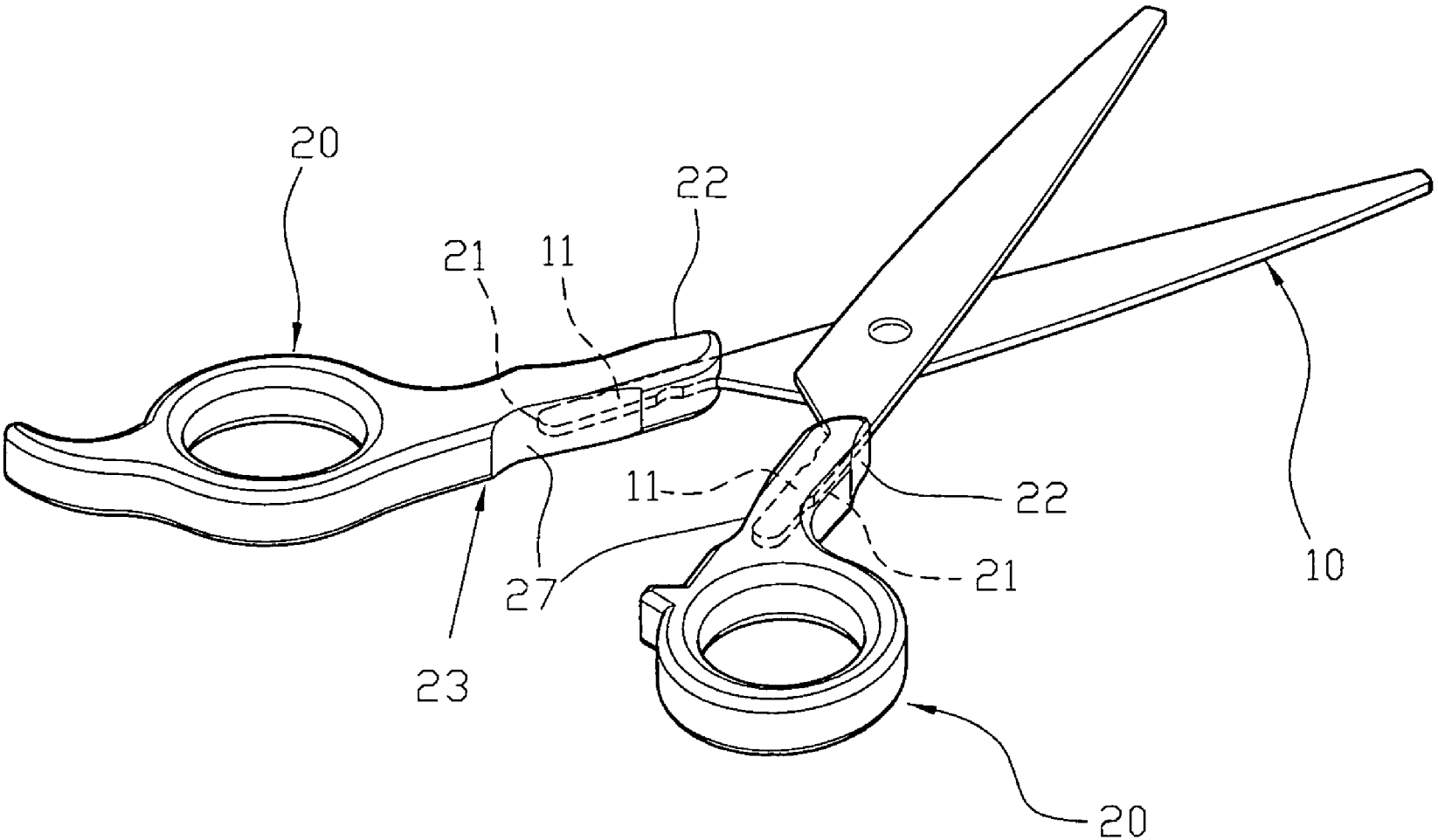
FIG. 5 is a perspective view of a cutting tool in accordance with another preferred embodiment of the present invention.
Figure 6:
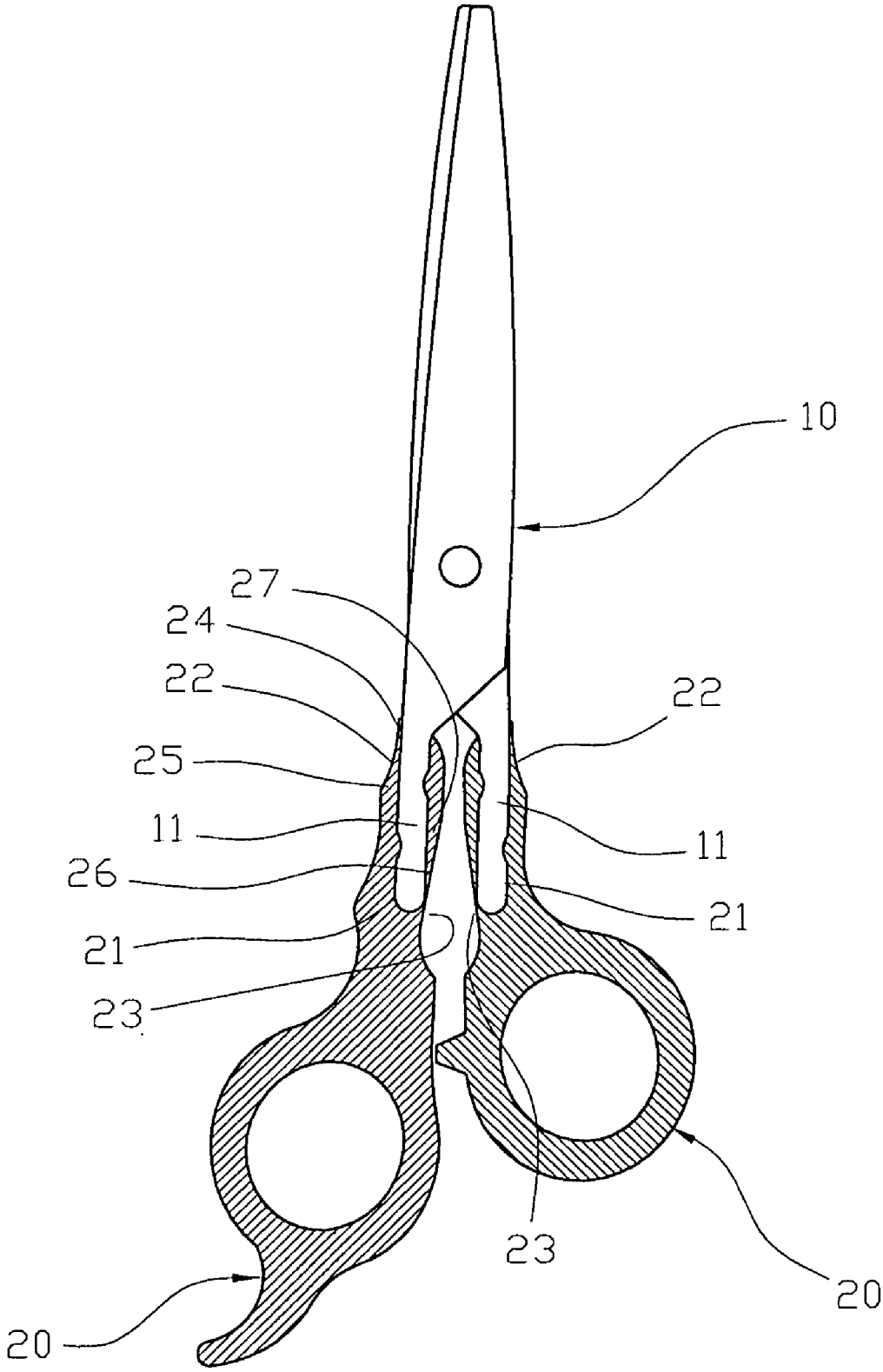
FIG. 6 is a plan cross-sectional view of the cutting tool as shown in FIG. 5.

As shown in FIGS. 5 and 6, each of the plastic grips 20 has a surface that is cut to form the first separation slot 22 and the second separation slot 23.

Accordingly, the plastic grips 20 are detachable from the metal handles 10 when the cutting tool is worn out, so that the plastic grips 20 and the metal handles 10 are separated from each other, thereby facilitating reuse of the plastic grips 20 and the metal handles 10. In addition, the user applies a bending force on the plastic grips 20 relative to the metal handles 10 to break the first separation slot 22 and the second separation slot 23 of each of the plastic grips 20, thereby separating the plastic grips 20 from the metal handles 10. Further, the bending force is applied on the first separation slot 22 and the second separation slot 23 of each of the plastic grips 20 from the starting portion 24 and 26 having the smallest thickness and weakest strength so that the first separation slot 22 and the second separation slot 23 of each of the plastic grips 20 are broken easily and rapidly, thereby saving the manual work, and thereby facilitating the user separating the plastic grips 20 from the metal handles 10.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A cutting tool, comprising:

two metal handles pivotally connected with each other and each having a first end formed with a mounting portion and a second end formed with a blade portion;

two plastic grips each mounted on a respective one of the metal handles and each having an inside formed with a mounting hole mounted on the mounting portion of the respective metal handle;

wherein the mounting hole of each of the plastic grips has a first end formed with a first separation slot and a second end formed with a second separation slot;

the first end of the mounting hole of each of the plastic grips has an opening having a side defining the first separation slot;

the second end of the mounting hole of each of the plastic grips has a wall defining the second separation slot;

the first separation slot of each of the plastic grips has an outer side having a starting portion and an ending portion;

the first separation slot is bendable from each of the plastic grips from the starting portion of the first separation slot;

the second separation slot of each of the plastic grips has an outer side having a starting portion and an ending portion;

the second separation slot is bendable from each of the plastic grips from the starting portion of the second separation slot.

2. The cutting tool in accordance with claim 1, wherein the first separation slot and the second separation slot are located at two opposite sides of the mounting hole of each of the plastic grips and misalign with each other.

3. The cutting tool in accordance with claim 1, wherein the outer side of the first separation slot of each of the plastic grips has a thickness gradually increased from the starting portion to the ending portion.

4. The cutting tool in accordance with claim 3, wherein the outer side of the second separation slot of each of the plastic grips has a thickness gradually increased from the starting portion to the ending portion, and the thickness of the outer side of the second separation slot is increased toward a direction opposite to that of the first separation slot.

5. The cutting tool in accordance with claim 1, wherein the mounting portion of each of the metal handles is inserted through the first end into the second end of the mounting hole of the respective plastic grip.

6. The cutting tool in accordance with claim 1, wherein the ending portion of the first separation slot and the ending portion of the second separation slot are located between the starting portion of the first separation slot and the starting portion of the second separation slot.

* * * * *